US012527394B1

(12) United States Patent
Chen et al.

(10) Patent No.: US 12,527,394 B1
(45) Date of Patent: Jan. 20, 2026

(54) ELECTRIC SHAVING BRUSH AND SHAVING ASSEMBLY

(71) Applicant: SHENZHEN SHUGE MEDICAL BEAUTY DEVICES CO., LTD., Shenzhen (CN)

(72) Inventors: Sijia Chen, Shenzhen (CN); Zuowo Xie, Shenzhen (CN); Shengbiao Lin, Shenzhen (CN); Yingying Li, Shenzhen (CN)

(73) Assignee: SHENZHEN SHUGE MEDICAL BEAUTY DEVICES CO., LTD., Shenzhen (CN)

( * ) Notice: Subject to any disclaimer, the term of this patent is extended or adjusted under 35 U.S.C. 154(b) by 0 days.

(21) Appl. No.: 19/017,650

(22) Filed: Jan. 11, 2025

(30) Foreign Application Priority Data

Sep. 7, 2024 (CN) ..... 202422198374.0
Sep. 14, 2024 (CN) ..... 202422273559.3

(51) Int. Cl.
*A46B 5/00* (2006.01)
*A46B 13/00* (2006.01)
(Continued)

(52) U.S. Cl.
CPC ..... *A46B 5/0095* (2013.01); *A46B 13/008* (2013.01); *A46B 13/02* (2013.01); *A46B 15/0004* (2013.01); *A46B 2200/1033* (2013.01)

(58) Field of Classification Search
CPC ..... A46B 2200/1033; A46B 5/0095; A46B 13/02–06; A45D 27/14; A45D 27/16; A45D 27/18; A45D 27/22; A45D 19/06; A45D 27/04; A45D 40/261; A45D 40/262; A45D 40/264; A45D 40/265; A45D 34/04; A45D 34/042; A45D 34/043; A45D 34/045; A45D 27/28; A45D 27/29; A45C 11/00–38
(Continued)

(56) References Cited

U.S. PATENT DOCUMENTS 2,385,003 A * 9/1945 Katz ..... A45D 27/04 132/290
4,027,348 A * 6/1977 Flowers ..... A46B 13/02 601/114
(Continued)

FOREIGN PATENT DOCUMENTS

WO WO-2023192098 A1 * 10/2023 ..... A46B 15/0026

*Primary Examiner* — Thomas C Barrett
*Assistant Examiner* — Holly T. To
(74) *Attorney, Agent, or Firm* — Cheng-Ju Chiang

(57) ABSTRACT

The present application relates to an electric shaving brush and shaving assembly. The electric shaving brush comprises a brush head and a handle. The brush head is detachably and rotatably connected to a top side of the handle; a control circuit board, a motor and a gear set are provided inside the handle; the motor electrically connected to the control circuit board; the gear set comprises a motor gear and an output gear, the motor drives the motor gear to take the output gear to rotate, an output shaft of the output gear is connected to the brush head to drive the brush head to rotate, and the electric shaving brush is capable of executing: a working mode of foaming, a working mode of applying lather to the skin or hair; a working mode of cleaning bristles and/or, a working mode of drying the bristles.

14 Claims, 12 Drawing Sheets

(51) Int. Cl.
*A46B 13/02* (2006.01)
*A46B 15/00* (2006.01)

(58) Field of Classification Search
USPC ..... 15/22.1; 206/208–209, 228; 220/4.21, 220/23.86, 23.87, 697, 735, 736
See application file for complete search history.

(56) References Cited

U.S. PATENT DOCUMENTS 4,644,645 A * 2/1987 Audet ..... A45D 27/29 30/41
4,656,738 A * 4/1987 Corah ..... B65D 83/285 30/41
4,927,046 A * 5/1990 Armstrong ..... B44D 3/121 220/736
5,806,669 A * 9/1998 Kim ..... B65D 83/285 206/349
7,389,892 B2 * 6/2008 Park ..... B44D 3/128 132/148
9,060,595 B2 * 6/2015 Grez ..... A46B 13/00
9,801,448 B1 * 10/2017 Jakubow ..... A46B 13/02
10,799,015 B1 * 10/2020 Velazquez ..... A46B 11/08
10,881,194 B2 * 1/2021 Machiorlette ..... G09B 19/24
2008/0149634 A1 * 6/2008 Osborne ..... A47G 21/145 220/521
2008/0222902 A1 * 9/2008 Bisceglia ..... B65D 23/12 30/541
2008/0296244 A1 * 12/2008 Tomassetti ..... A47K 3/281 211/119.009
2011/0114107 A1 * 5/2011 Muhl ..... A45D 19/06 132/200
2012/0124758 A1 * 5/2012 Sabisch ..... A61C 17/3445 15/21.1
2012/0294666 A1 * 11/2012 Jang ..... A46B 17/04 401/126
2013/0318729 A1 * 12/2013 Suwanbutr ..... A46B 13/02 15/23
2015/0314464 A1 * 11/2015 Guzak ..... B26B 21/521 30/526
2016/0324306 A1 * 11/2016 Martin ..... A46B 9/021
2017/0215548 A1 * 8/2017 Kohler ..... A45D 27/16
2017/0238686 A1 * 8/2017 Sanchez Martinez ..... A46B 15/0014
2018/0055190 A1 * 3/2018 Anastasis ..... A45D 27/22
2018/0242711 A1 * 8/2018 Poole ..... A46B 9/021
2021/0307480 A1 * 10/2021 Zucker ..... B01F 27/071
2022/0175108 A1 * 6/2022 Desmarais ..... F16M 13/02
2022/0279916 A1 * 9/2022 Riley ..... A46B 5/0095
2022/0295974 A1 * 9/2022 Akbar ..... B44D 3/126
2022/0322807 A1 * 10/2022 Donato ..... A45D 27/29
2024/0365969 A1 * 11/2024 Li ..... A46B 5/0095

* cited by examiner

ELECTRIC SHAVING BRUSH AND SHAVING ASSEMBLY

CROSS REFERENCE TO RELATED APPLICATIONS

The present invention claims 35 U.S.C. § 119 benefit of earlier filing dates; rights of priority of Chinese Applications No. 202422198374.0 filed on Sep. 7, 2024, and Chinese Application No. 202422273559.3 filed on Sep. 14, 2024, the disclosure of which is incorporated by reference herein.

BACKGROUND OF THE INVENTION

Field of the Invention

The present invention relates to the field of a shaving product, and more particularly, to an electric shaving brush and a shaving assembly.

Description of Related Art

This invention relates to a brush typically used in applying shave cream. Shaving brushes have been used historically to prepare hair and skin ahead of wet shaving. A user would work up soap or gel into lather either against their face, in a shaving mug/bowl, or in the palm of their wet hand. The user would then apply the lather to their skin with the brush, typically using rapid short strokes, and in the process would agitate hairs lying on the skin and enhance the condition of the skin by providing exfoliation. The benefits felt by a user during and after shaving are generally dependent on the quality of the bristles of the brush and the manner in which the lather is applied to the face. The application of lather is dependent on the motion of the user's hand which can limit the benefits of using a brush if not performed correctly.

In pursuit of an improved shaving product, there is a need for a shaving brush capable of effectively stimulating the skin, raising hairs off the face, exfoliating, and lubricating as well as moisturizing the skin that is not solely dependent on the motion of a user's hand. Thus, there is a need for an electric shaving brush that can produce an automated bristle motion to optimize the effects desired with using a brush.

SUMMARY OF THE INVENTION

An object of the present invention is to is to provide an electric shaving brush that can lather shave cream automatically and quickly.

In a first aspect, the present invention provides an electric shaving brush comprises a brush head and a handle; the brush head is detachably and rotatably connected to a top side of the handle; a control circuit board, a motor and a gear set are provided inside the handle; the motor electrically connected to the control circuit board; the gear set comprises a motor gear and an output gear, the motor drives the motor gear to take the output gear to rotate, an output shaft of the output gear is connected to the brush head to drive the brush head to rotate, and the electric shaving brush is capable of executing one or more working modes of:

- a working mode of foaming: where the brush head rotates at a first speed to make shave cream into lather automatically and quickly and produce more denser and richer lather;
- a working mode of applying lather to the skin or hair;

- a working mode of cleaning bristles: where the brush head rotates at a third high speed to wash residual lather in bristles in water; and/or,
- a working mode of drying the bristles: where the brush head rotates at a fourth high speed to dry residual water in the bristles.

In some embodiments, a magnetic adsorption connection is formed between the brush head and the handle; the brush head comprises bristles, a bristle cup and a first magnet; the first magnet and the bristles are installed to the bristle cup and are fixed together in a rotation direction of the brush head; a second magnet is provided at the top side of the handle; the output shaft of the output gear is connected to the bristle cup to take the bristle cup to rotate together; when the brush head is connected to the top side of the handle, the magnetic attraction is formed between the first magnet and the second magnet.

A second aspect, the present invention provides a shaving assembly, comprising a shaving bowl and the electric shaving brush; a bracket is provided on an open edge of the shaving bowl, and the bracket is rotatable and adjustable to support the electric shaving brush at various positions.

In some embodiments, a third magnet is provided in the handle of the electric shaving brush, and a fourth magnet is provided in the bracket; the handle is attracted to the bracket through a magnetic force between the third magnet and the fourth magnet.

In some embodiments, the bracket comprises: a bearing seat, which is fixed on an outer wall of the shaving bowl and defines one or more shaft holes; a rotatable arm, which defines one or more shaft holes; a supporting plate; and a shaft. The rotatable arm is rotatably connected to the bearing seat through the shaft; the supporting plate is connected to the rotatable arm; the rotatable arm is adapted to the bearing seat, the shaft is rotatably inserted in the shaft holes of the rotatable arm and the bearing seat; a fourth magnet is provided in the supporting plate to form a magnetic attraction with the third magnet in the handle; the supporting plate has a curved surface, the handle has a corresponding curved surface, the curved surfaces of the supporting plate and the handle match to each other, whereby contact surfaces of the supporting plate and the handle are fitted to each other.

The advantages of the present invention are:

- the electric shaving brush of the present invention can work up shave cream (including soap or gel, etc.) into lather automatically and quickly, richer lather can be produced using the brush head with bristles at a first high rotational speed level, which can be applied to the skin with a good user experience.

In other embodiments, the electric shaving brush with the brush head rotates at a second high rotational speed level to clean the residual lather in the bristles quickly and efficiently; after cleaning, the residual moisture in the bristles can be quickly dried when the electric shaving brush with the brush head rotates at a third high rotational speed level.

In other embodiments, a shaving bowl is provided to hold the electric shaving brush for automatic foaming, cleaning or storing.

DETAILED DESCRIPTION OF THE INVENTION

Figure 1:
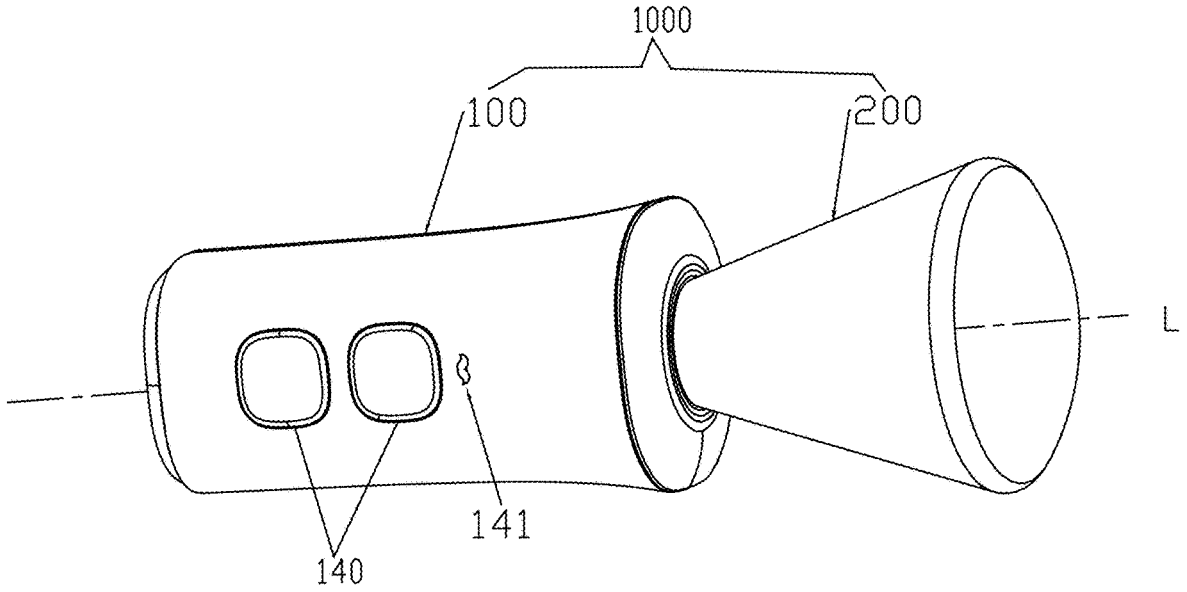
FIG. 1 illustrates a perspective view of an electric shaving brush in accordance with an embodiment of the present invention.
Figure 2:
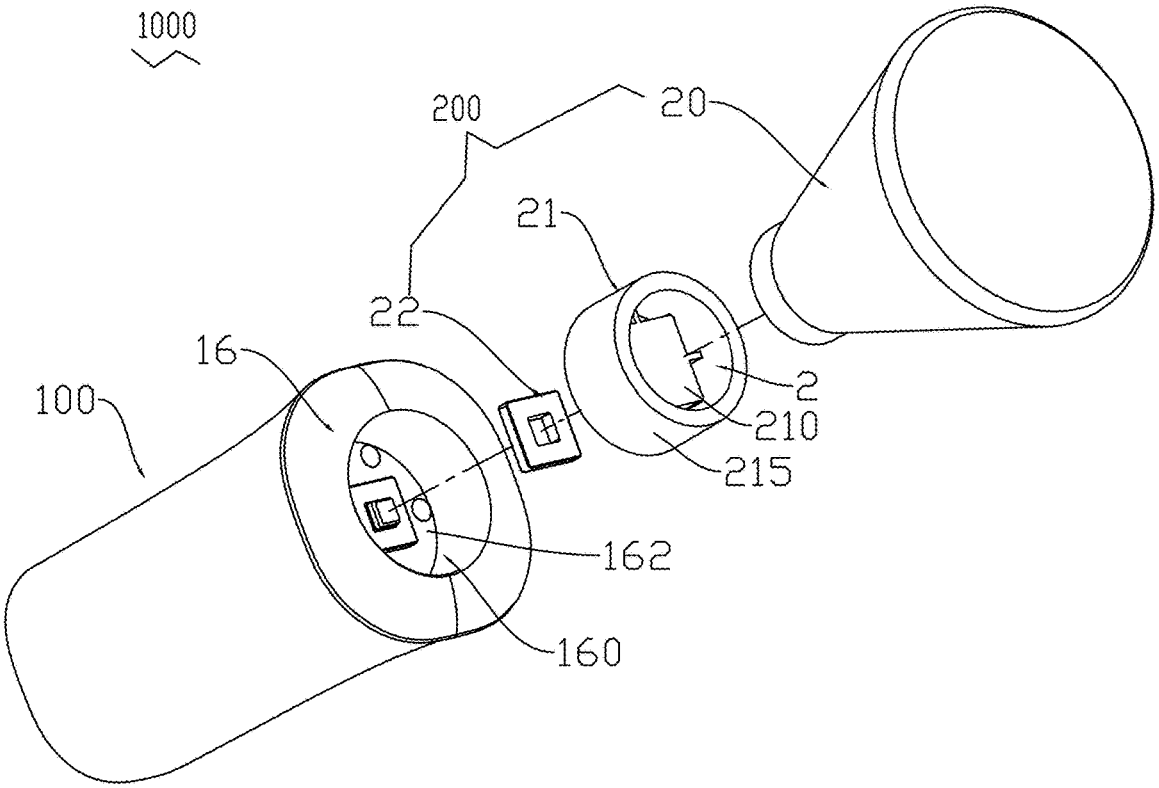
FIGS. 2-4 illustrate exploded views of the electric shaving brush in accordance with a first embodiment of the present invention.
Figure 3:
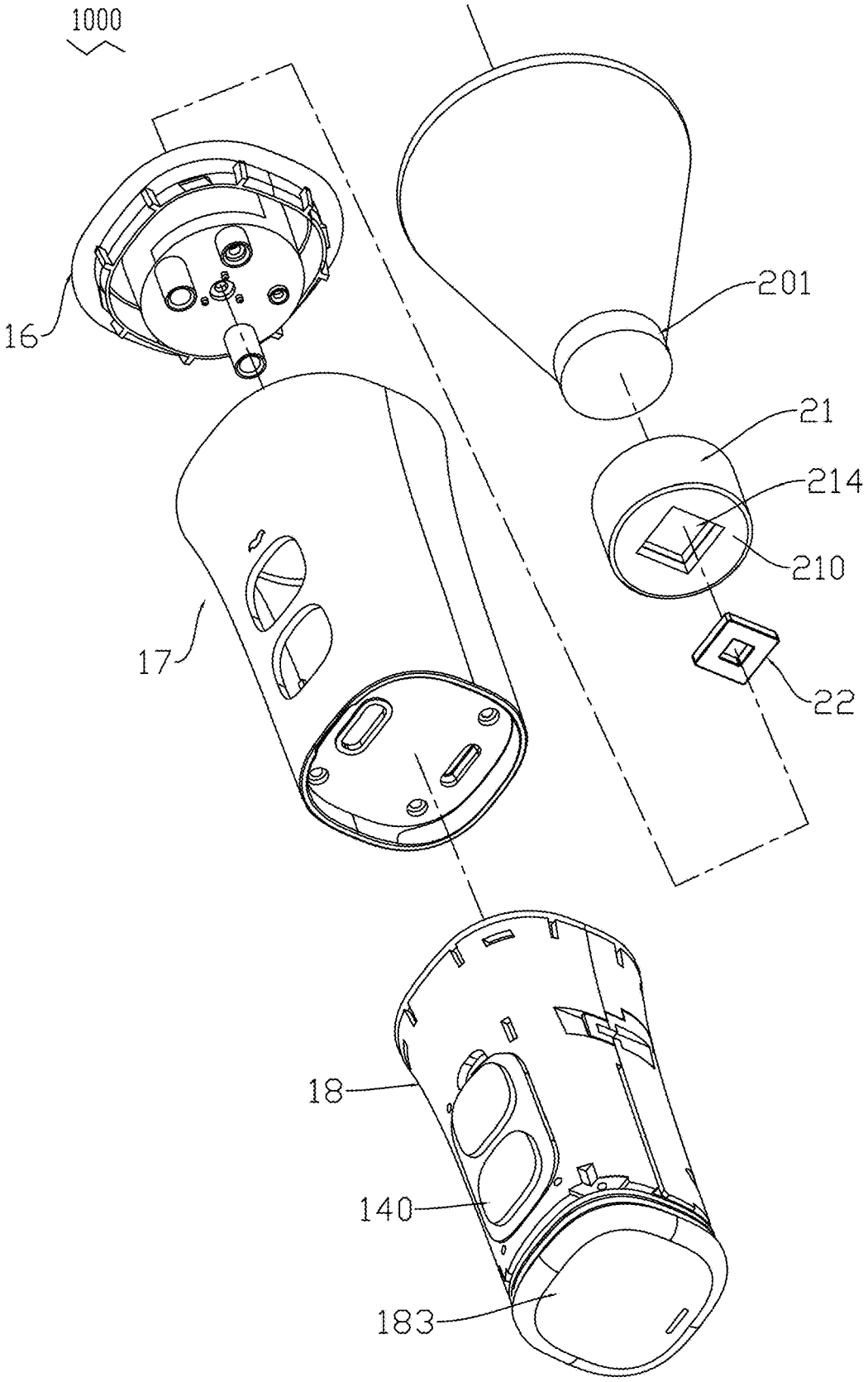
Figure 4:
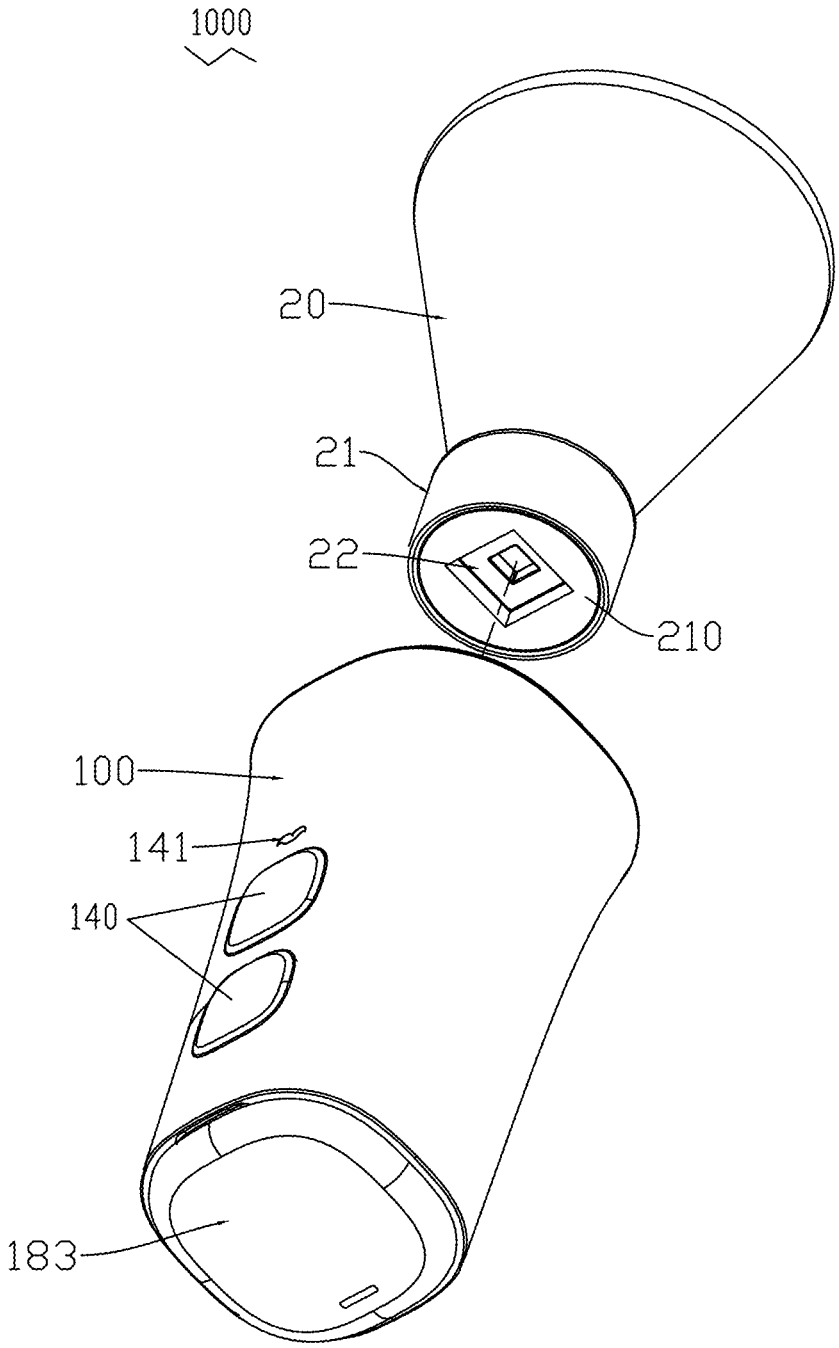
Figure 5:
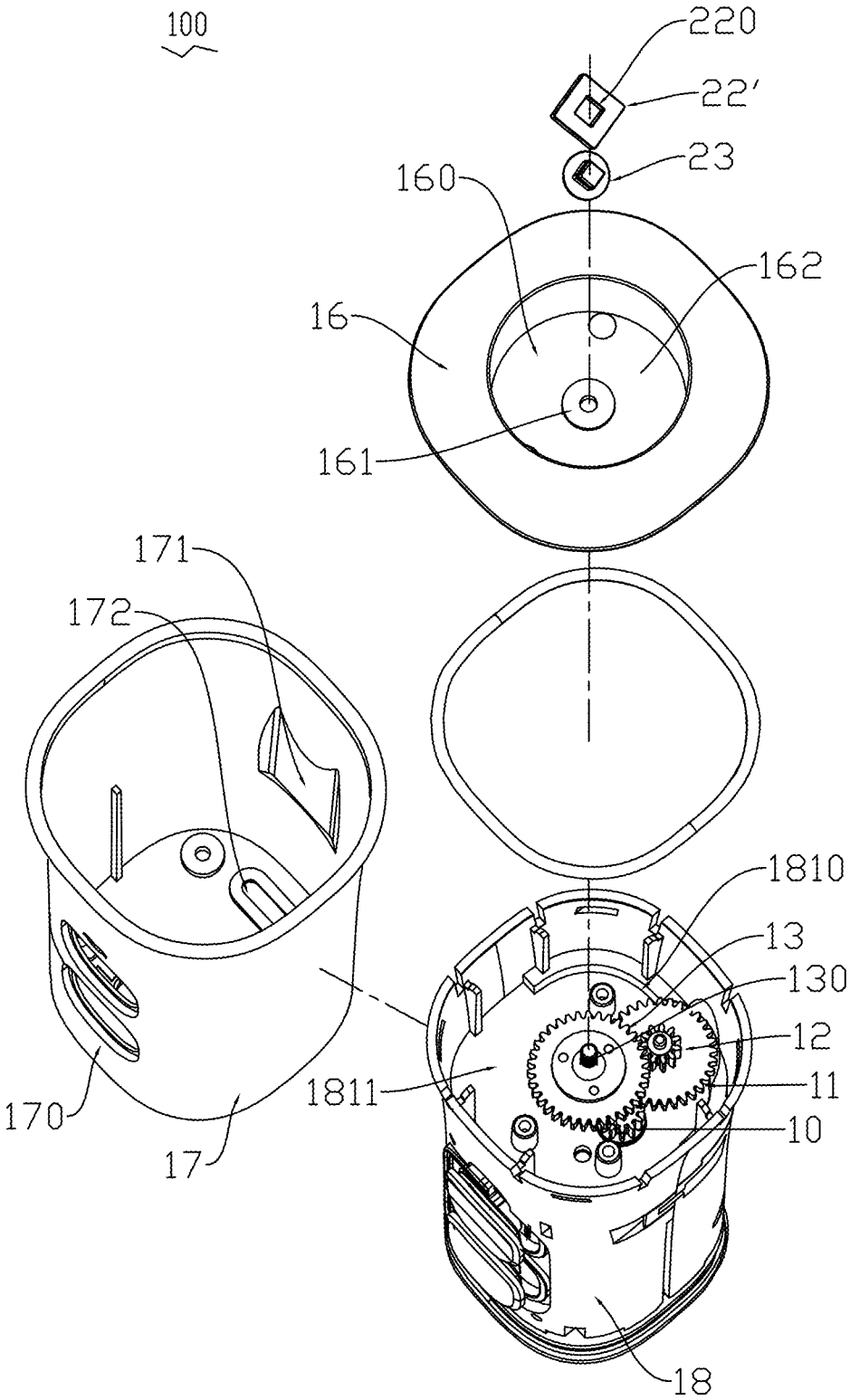
FIGS. 5-7 illustrate exploded views of a handle of the electric shaving brush in accordance with the first embodiment of the present invention.
Figure 6:
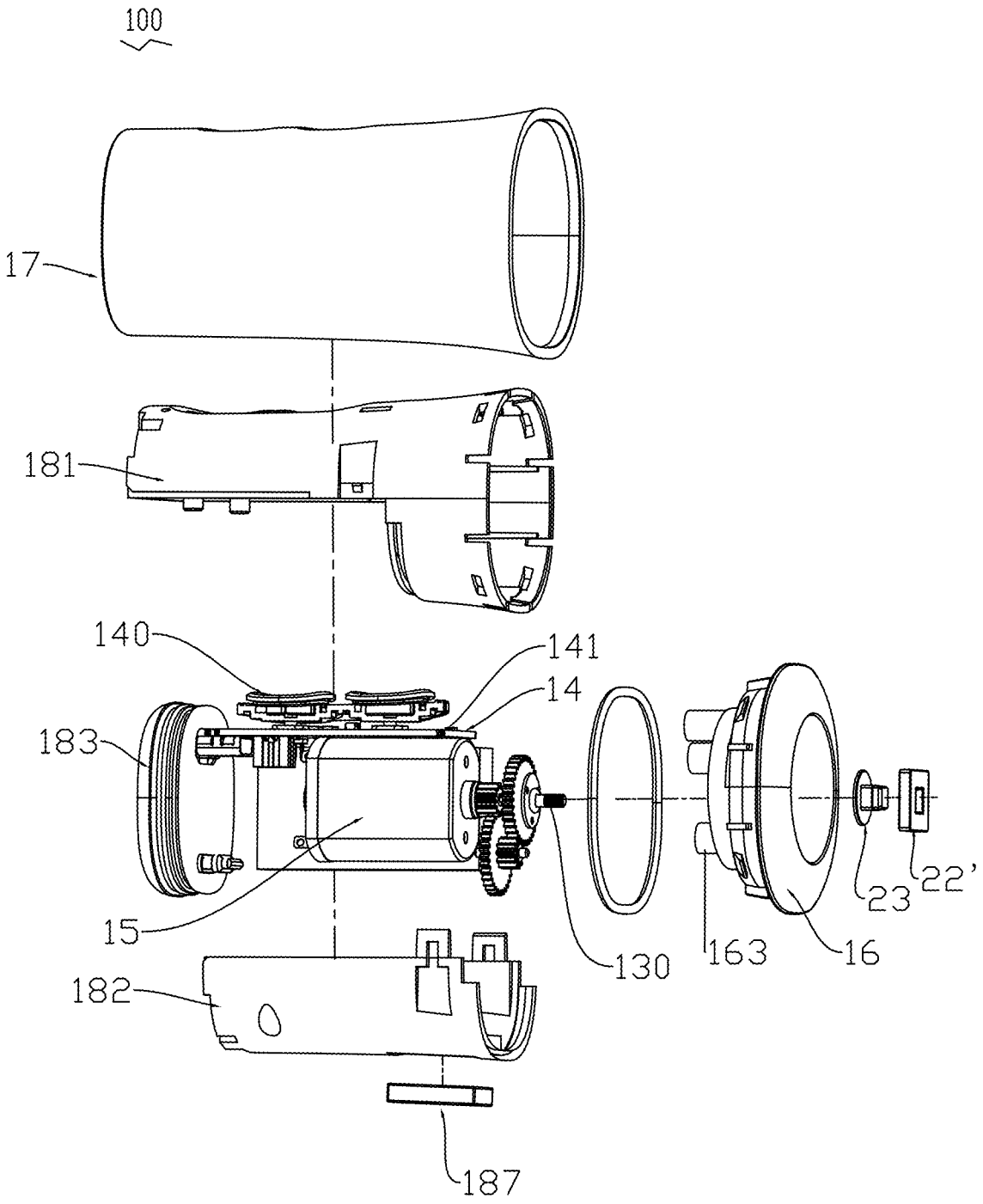
Figure 7:
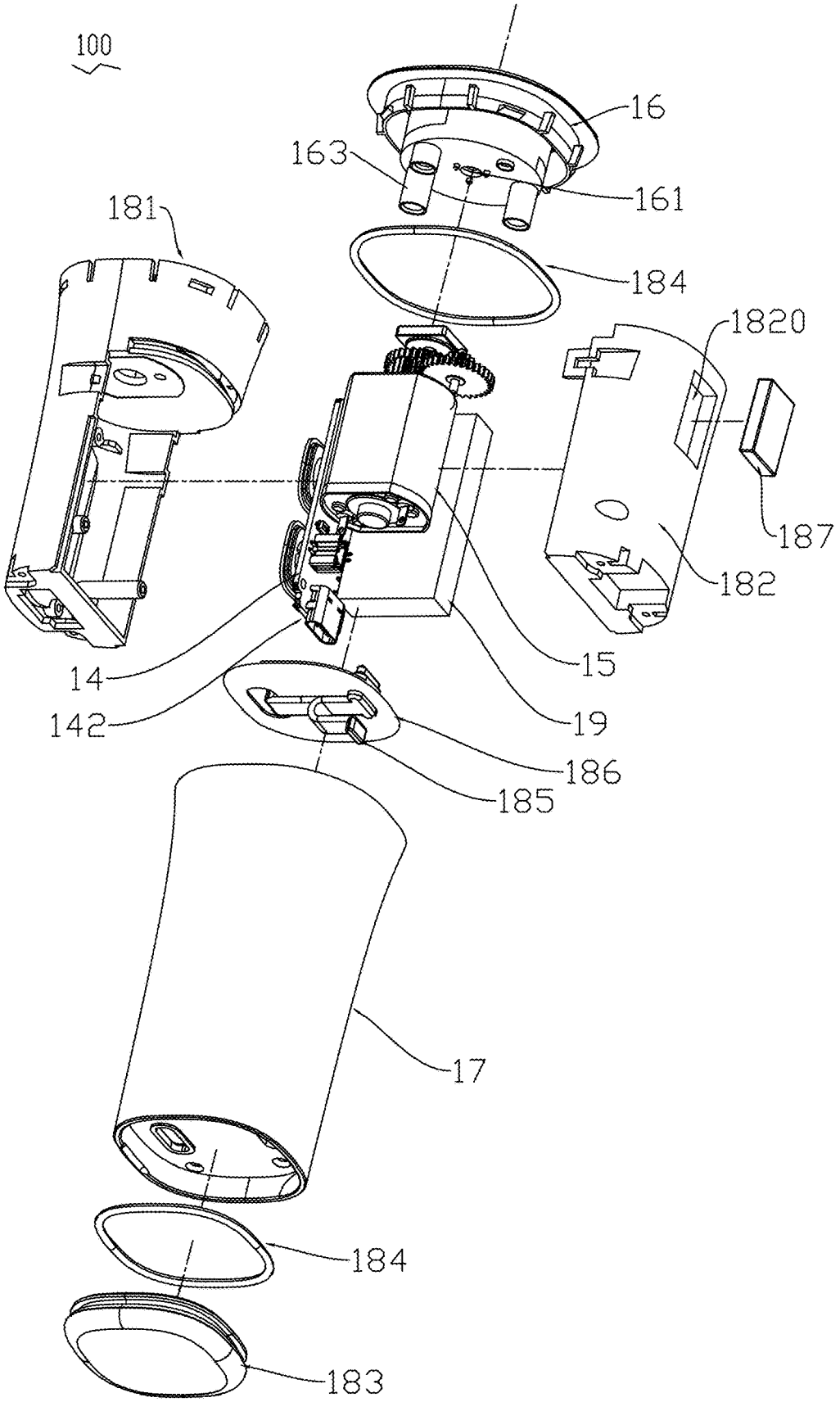
Figure 8:
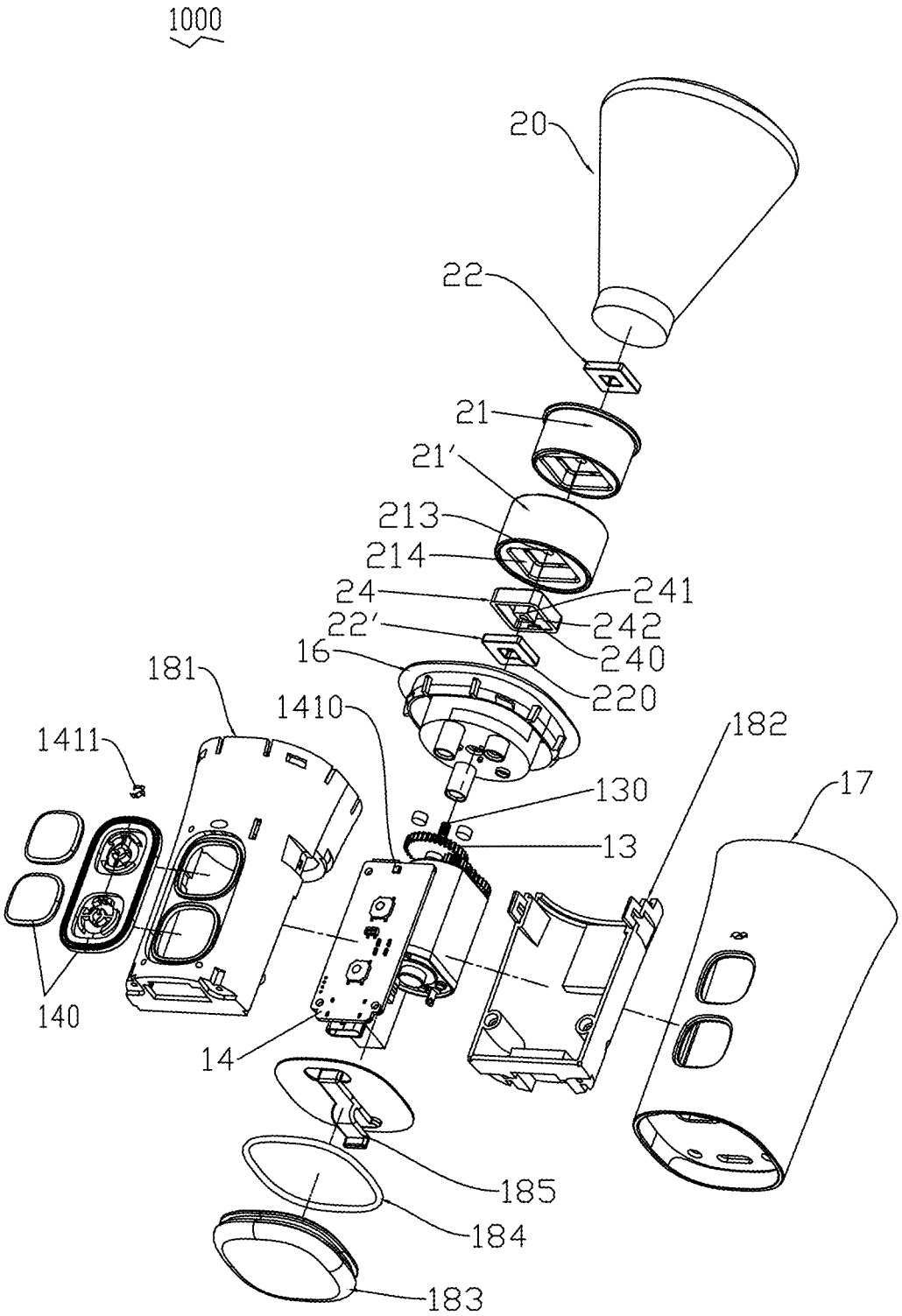
FIGS. 8-10 illustrate exploded views of the electric shaving brush in accordance with a second embodiment of the present invention.
Figure 9:
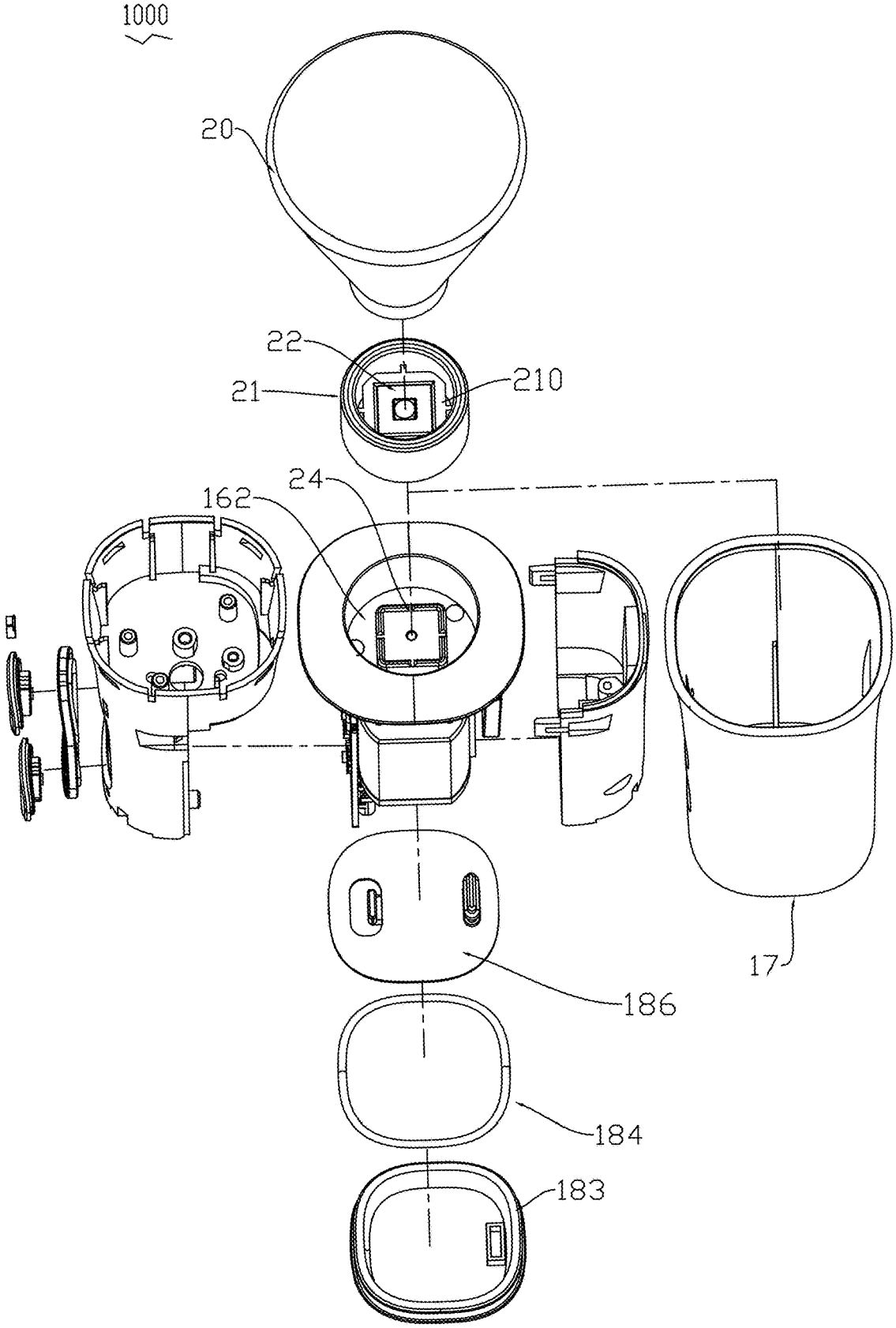
Figure 10:
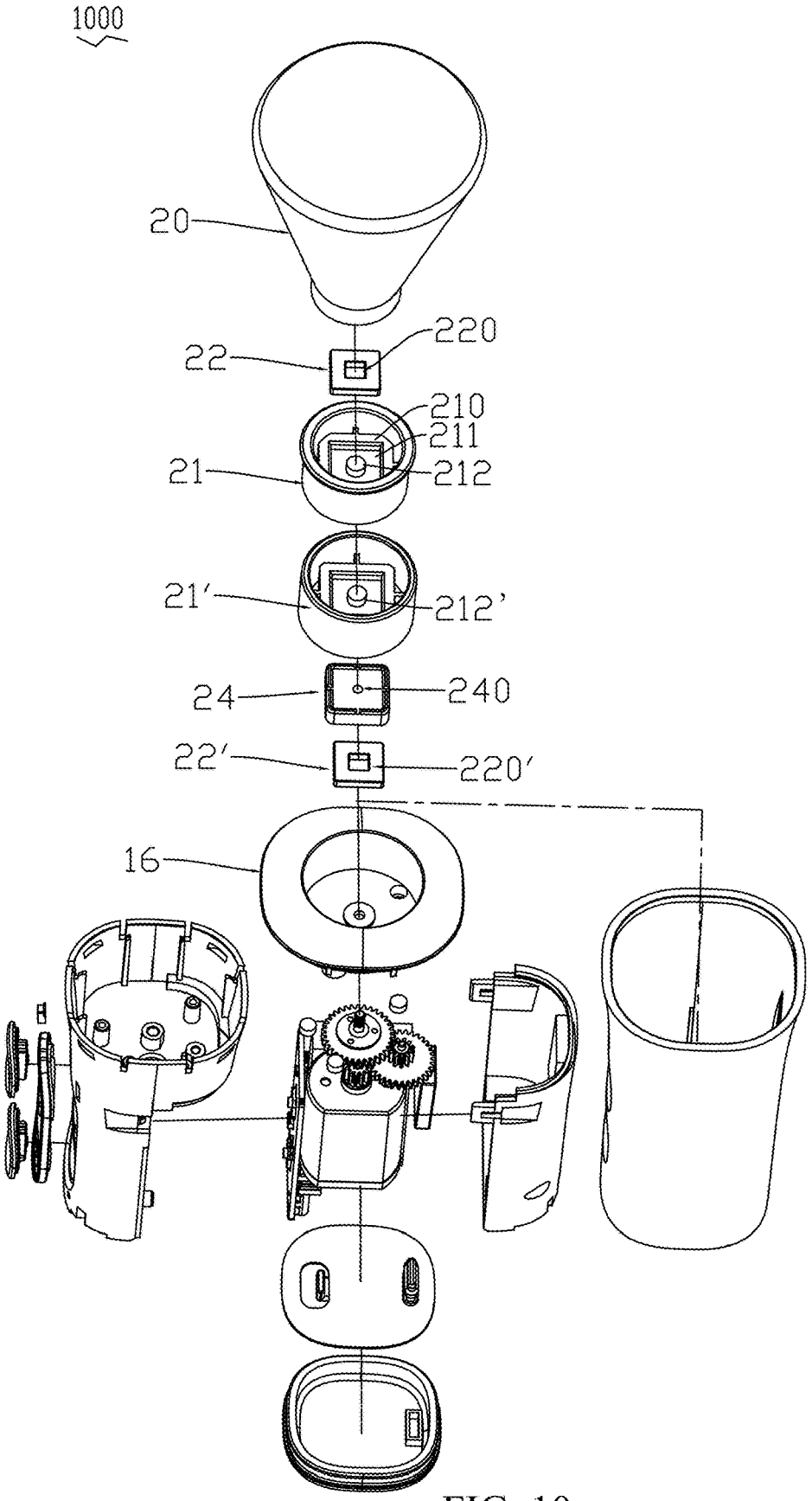
Figure 11:
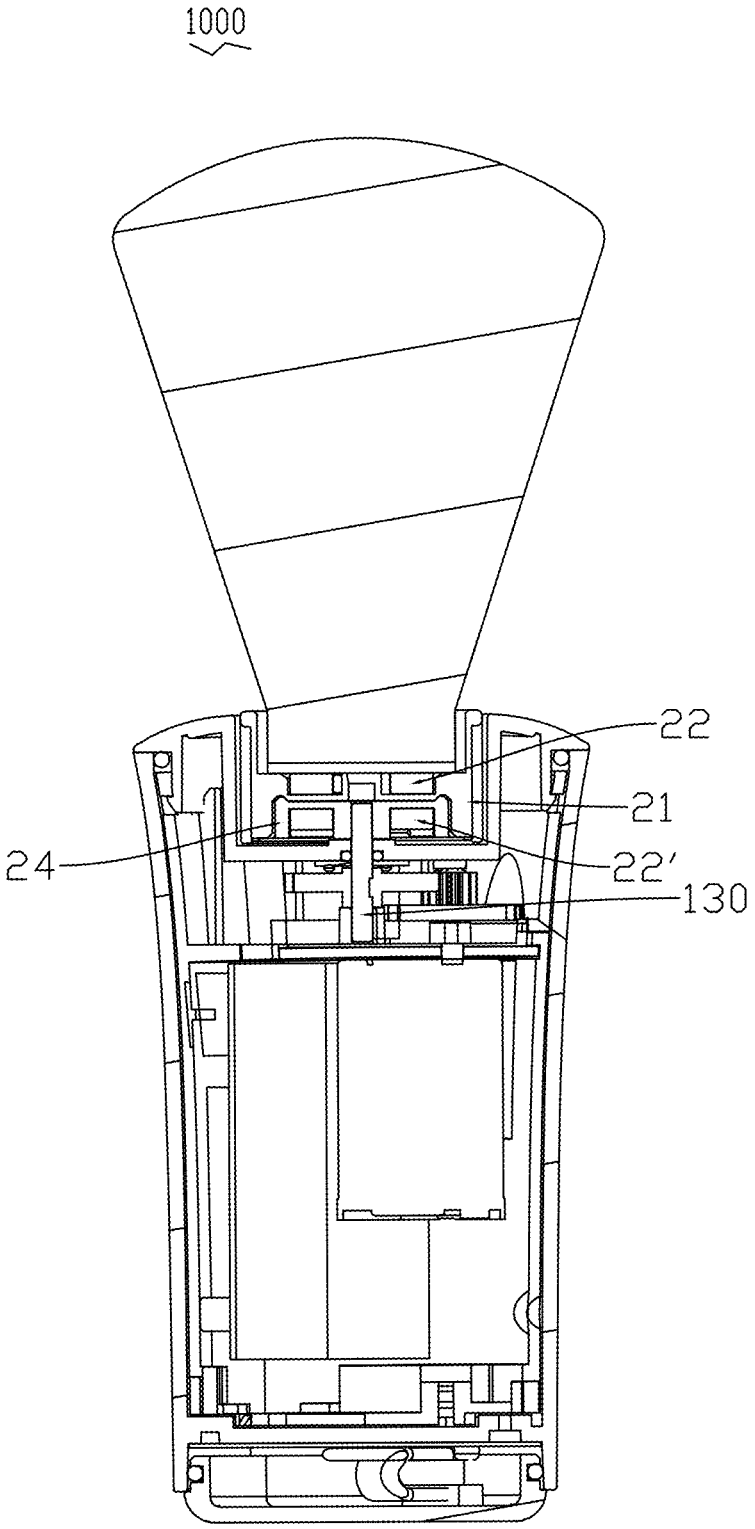
FIG. 11 illustrates a cross-sectional view of the electric shaving brush in accordance with the second embodiment of the present invention.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limited exemplary embodiments. The features illustrated or described in connection with one exemplary embodiment may be combined with the features of other embodiments. Such modifications and variations are intended to be included within the scope of the present invention.

Certain terminology is used in the following description for convenience only and is not limiting. The words "a", "an" and "one", as used in the claims and in the corresponding portions of the specification, are defined as including one or more of the referenced items unless specifically stated otherwise. Although the terms "first", "second", etc. may be used herein to describe various elements, components, regions, layers and/or sections, these elements, components, regions, layers and/or sections shall not be referred to as restricted by these terms. These terms are only used to distinguish one element, component, region, layer or section from another element, component, region, layer or section. Terms such as "first," "second," and other numerical terms when used herein do not imply a sequence or order unless clearly indicated by the context.

It will be further appreciated that, for the convenience of description, as used in the claims and in the corresponding portions of the specification, spatial terms such as "vertical," "horizontal," "up", "down", "internal", "external", "inside", "outside", "below", "beneath", "under", "on", "top", "bottom", "front", "rear", "left", "right" and etc., may be used herein. However, the device is used in various orientations or positions, and these spatial terms are not intended to be limited and/or absolute. For example, if the device in the figures is turned over, elements described as "below" other elements or features would then be oriented "above" the other elements or features, the term "below" herein may include an orientation of "above" and "below". The device may be otherwise oriented (such as rotated 90 degrees or at other orientations), and the orientation herein should be interpreted accordingly.

In the embodiments in combination with drawings will be described below, a central line L of the electric shaving brush is longitudinal, and a rotation direction is along the central line L, that is, the central line L is the central axis of rotation.

Referring to FIGS. 1-11, an electric shaving brush 1000 of the present invention, comprises a handle 100 and a brush head 200. The brush head 200 is detachably and rotatably connected to a top side of the handle 100.

The brush head 200 is detachably and replaceably connected with the handle 100. For shaving hair on different skin areas, various brush heads with different textures or sizes may be necessary; and different brush heads can be selected to use for health, hygiene and a comfort experience. Different brush heads 200 can be designed in different diameters, lengths or hardness, etc. For example, a first brush head 200 has a diameter of 20 mm and a hair length is 55 mm; a second brush head 200 has a diameter of 18 mm and a hair length of 52 mm; and bristles with different hardness and/or texture can also be used.

The electric shaving brush 1000 of the present invention, is provided with the shaving bowl 300 (refer to FIGS. 9-11), has the brush head 200 rotating at preset speeds, and can perform at least one of working modes below:

- a working mode of foaming: where he brush head 200 rotates at a first speed to make shave cream/soap/gel in the shaving bowl into lather automatically and quickly and produce denser and richer lather;
- a working mode of applying lather to the skin or hair: where the brush head 100 rotates at a second speed for effectively stimulating the skin, raising hairs off the face, exfoliating, and lubricating as well as moisturizing the skin;
- a working mode of cleaning bristles: where the brush head 100 rotates at a third speed to clean the bristles in water or in a solution to wash off residual lather in the bristles quickly; and/or,
- a working mode of drying bristles: where the brush head 100 rotates at a fourth speed to dry residual water in the bristles.

The first speed, the third speed and the fourth speed are the same or different, and are preset high rotational speed levels.

In a specific embodiment, the brush head 200 is detachably, replaceably and rotatably connected to the top side of the handle 100. The brush head 200 is connected to the top side of the handle 100 through magnetic adsorption. The brush head 200 includes bristles 20, a bristle cup 21 and a first magnet 22. The bristles 20 and the first magnet 22 are installed in the bristle cup 21, which may be fixedly installed in the bristle cup 21, or may be fixed in a rotation direction of the brush head 200 while may be detachable along a central line L or a longitudinal direction of the electric shaving brush 1000. When the brush head 200 rotates relative to the handle 100, the bristles 20, the bristle cup 21 and the first magnet 22 rotate synchronously together.

The bristles 20 are a bunch of bundles attached to a bristle base 201. The bristle base 201 can be formed by roots of bundles bonding together; and/or the bristle base 201 is an independent component, and the roots of the bristles are bonded and fixed in the bristle base 201.

The bristle cup 21 is cylindrical, but not limited to a cylindrical shape, and includes an annular sidewall 215 and a bottom wall 210. A top open side of the bristle cup 21 forms an assembly cavity 2 for installing the bristles 20 and adaptively receiving the bristle base 201. The assembly cavity 2 is adapted to the bristle base 201. The bristle base 201 is fixed in the assembly cavity 2 of the bristle cup 21; or the bristle base 201 is relatively fixed in the rotation direction (no relative rotation occurs) in the assembly cavity 2, but can be pulled out along a longitudinal direction or along the central line L. The bristle base 201 and the bottom wall 210 of the bristle cup 21 fit together in the cavity 2. In a non-limited example, the bristle base 201 and the bristle cup 21 may be made of magnetic materials such as iron or magnet.

Referring to FIGS. 1-7, in the first embodiment, a bottom side of the bristle cup 21 is recessed to form a mounting slot 214, the bottom wall 210 divides an inner space of the bristle cup 21 into the upper assembly cavity 2 and the lower mounting slot 214. The mounting slot 214 is adapted to the first magnet 22, and is used to install the first magnet 22. The mounting slot 214 may be a recess that does not penetrate the bottom wall 210, or a through hole that penetrates the bottom wall 210. For example, the shape of the first magnet 22 is square, and the mounting slot 214 is a square slot. The first magnet 22 may be fixed in the mounting slot 214, or may be fixed in the rotating direction while may be pulled out in the longitudinal direction or central line L. A center of the first magnet 22 defines a through hole 220. When the brush head 200 is connected to the top side of the handle 100, an end of the output shaft 130 of an output gear 13 is tightly fitted in the through hole 220 or fixed in the rotation direction. The shape of the central through hole 220 may be polygon, and there is no relative rotation between the output shaft 130 of the output gear 13 and the first magnet 22. In a non-limited example, the first magnet 22 may form magnetic adsorption with the bristle cup 21 and/or the bristle base 201. When disassembling the brush head 200, the brush head 200 can be pulled out from the top side of the handle 100, and then the brush head 200 can be replaced, or further the bristles 20 can be replaced. The first magnet 22 is a permanent magnet.

A top cavity 160 is formed in a top side of the handle 100, which is adapted to the bottom of the brush head 200. The bristle cup 21 is accommodated in and is rotatable relative to the top cavity 160. The brush head 200 can be pulled out from the top cavity 160 along the longitudinal direction or along the central line L. A second magnet 22' is installed in the top cavity 160 and rests on the bottom wall 162 of the top cavity 160. The second magnet 22' protrudes upward from the bottom wall 162 and is installed on the output shaft 130 of the output gear 13. When the brush head 200 is connected to the handle 100, the bristle cup 21 is inserted in the top cavity 160 of the handle 100, and the second magnet 22' protruding upward from the bottom wall 162 of the top cavity 160 is inserted into the bottom wall 210 of the bristle cup 21. The two magnets 22 and 22' are magnetically attracted to each other, placed up and down, and coaxially sleeved at the end of the output shaft 130. As an example, the second magnet 22' is the same as (or different from) the first magnet 22, and central through holes 220, 220' of the two magnets 22, 22' may be non-circular through holes, such as square holes. The two magnets 22, 22' are connected by the same output axis 130 and fixed together in the rotation direction.

The handle 100 includes a hollow housing 17 for holding a frame 18 therein; and a motor 15, a gear set, a control circuit board 14 and a battery 19 are mounted to the frame 18 in the housing 17. The gear set includes a motor gear 10, an intermediate gear and an output gear 13, and the gears mesh with each other for transmission. The motor 15 drives the motor gear 10 to rotate, the motor gear 10 drives the intermediate gear to rotate through gear meshing, and then the intermediate gear drives the output gear 13 to rotate through gear meshing. The motor 15 is controlled by the control circuit board 14 and corporates with the gear set so that the output shaft 130 of the output gear 13 can rotate at various speed levels, such as at a first high speed for foaming shave cream, a second speed for applying lather, a third high speed for cleaning bristles, and a fourth high speed for quick drying bristles. The rotation speed is adjustable according to actual conditions. There is one or more or no intermediate gear. The output shaft of the motor 15 is used as a central shaft of the motor gear 10, and the motor gear 10 is arranged at a top end of the output shaft of the motor 15. In one embodiment, there are two intermediate gears 11 and 12 coaxially aligned up and down, so that the two intermediate gears 11 and 12 rotate synchronously. The lower (first) intermediate gear 11 meshes with the motor gear 10, and the upper (second) intermediate gear 12 meshes with the output gear 13 to form a mesh transmission. In other embodiments, there is one intermediate gear mesh with the motor gear 10 and the output gear 13 respectively; or more than two intermediate gears can be used, the multiple intermediate gears are coaxially connected, or their central axes are parallel and the gears mesh with each other. The setting of multiple gears can achieve multi-speed levels. The output shaft (central shaft) 130 is tightly inserted through the central through hole of the output gear 13. An O-ring and O-gasket can be further provided to ensure a tight fit between the output shaft 130 and the output gear 13. The second magnet 22' is installed at the end of the output shaft 130. The end of the output shaft 130 is inserted into a central through hole 220 of the second magnet 22' and is relatively fixedly connected. The end of the output shaft 130 can be provided with external threads or structural features to increase friction. In one embodiment, the end of the output shaft 130 sleeved with a rubber piece 23 is inserted into the central through hole 220' of the second magnet 22'. The rubber piece 23 may be shaped as a cap, and can be provided with internal threads or structural features to increase friction so as to increase the friction or form a threaded fit between the end of the output shaft 130 and the rubber piece 23. The rubber piece 23 is matched with the center through hole 220' of the second magnet 22', for example is square. The end of the output shaft 130 of the output gear 13 is inserted into the central through hole 220' of the second magnet 22', and can be further inserted into the central through hole 220 of the first magnet 22 to connect the two magnets 22, 22' together in series, the two magnets 22, 22' attract each other. The motor 15 drives the motor gear 10 to rotate, the motor gear 10 takes the output gear 13 to rotate through the intermediate gear transmission, thus the output shaft 130 of the output gear 13 takes the brush head 200 to rotate together. The motor gear 10, the intermediate gears 11, 12 and the output gear 13 have their central shafts (as input shaft or output shaft) parallel or coaxial with the central line L of the electric shaving brush 1000.

The housing 17 is cylindrical or has a shape suitable for hand holding, for example, it has an annular sidewall with a curved surface, which is convenient for hand holding and resting on a rotatable bracket 30 with a curved surface 330 of the shaving bowl 300. The cylindrical housing 17 has an open top, and includes an annular sidewall and a bottom wall. The sidewall and bottom wall of the housing 17 can define one or more through holes 170, 172 for installing buttons, indicator lights, charging interfaces and other components. The bottom wall can also define one or more mounting holes, and fasteners such as screws are inserted into the mounting holes to fix the frame 18 and the housing 17 together. In an embodiment, a third magnet 187 is provided inside the housing 17, and a corresponding groove 171 is provided in the inner wall of the housing 17 to install and accommodate the third magnet 187. The third magnet 187 is used to form a magnetic adsorption between the electric shaving brush 1000 and the rotatable bracket 30 on the shaving bowl 300.

The frame 18 is adapted to the housing 17, is installed in the housing 17, and tightly fitted to each other through such as a snap fit or a tightly fit, and can be further fixed to each other through fasteners such as screws. A gear cavity 1811 is formed in the top side of the frame 18, and a main accommodation cavity is formed inside the frame 18 for installing the motor 15, the control circuit board 14, the battery 19 and other components. The gear set is received in the gear cavity 1811. In an exemplary embodiment, the frame 18 is cylindrical, including an annular sidewall, a top bottom wall 1810 at the upper end of the annular sidewall and a lower bottom wall at the lower end of the annular sidewall. The top bottom wall 1810 and the upper end of the annular sidewall together define the gear cavity 1811. The top bottom wall 1810 defines shaft holes, or is provided with pillars each with a shaft hole therein. The gear shafts of the gear set are rotatably inserted in the shaft holes by one to one correspondence, and the output shaft 130 of the output gear 13 rotatably insert through a central through hole through the top bottom wall 1810. The control circuit board 14, the motor 15 and the battery 19 are installed in the main accommodation cavity formed by the top bottom wall 1810, the annular sidewall and the bottom wall. The output shaft of the motor 15 extends upward through the corresponding shaft hole in the top bottom wall 1810 for rotatably installing the motor gear 10. The battery 19 may be a rechargeable battery. The frame 18 may be formed by interlocking a first frame 181 and a second frame 182. The top bottom wall 1810 and the gear cavity 1811 are formed in the top side of the first frame 181. The bottom wall of the frame 18 may be spliced by the bottom walls of the first frame 181 and the second frame 182. The first frame 181 is provided with through holes for installing a key module 140 and is provided with a through hole or a light-transmitting window for installing an indicator module 141. The second frame 182 is provided with a groove 1820 corresponding to the groove 171 on the inner wall of the housing 17 for jointly installing the third magnet 187. The lower bottom wall of the frame 18 is provided with a through hole for installing the charging interface 142, and the charging interface 142 extends outward from the lower bottom wall to facilitate connection with an electric wire. The indicator module 141 includes a light lamp 1410 and a light guide 1411, and passes the through holes (or is located behind light-transmitting windows) in the frame 18 and the housing 17.

The top side of the handle 100 is provided with a supporting plate 16, which covers the open top of the housing 17 and the frame 18, and covers the gear cavity 1811. The supporting plate 16 is fixed to the top of the housing 17 and the frame 18. The supporting plate 16 is recessed downward to form the top cavity 160. A central through hole 161 is defined in the center of the bottom wall 162 of the supporting plate 16. There is a space between the bottom wall 162 of the supporting plate 16 and the top bottom wall 1810 of the frame 18 for accommodating the gear set, the top end of the output shaft 130 of the output gear 13 passes through the central through hole 161 in the bottom wall 162 of the supporting plate 16, and passes through the through hole 220' of the second magnet 22' and is relatively fixed in the rotation direction. The bottom of the brush head 200 is installed in the top cavity 160 of the supporting plate. Pillars 163 may also be provided at the back of the supporting plate 16, and a through hole is provided in each pillar 163. The top end of the shaft of the intermediate gear can be inserted into the through hole of the pillar 163 in a relatively rotatable manner. An O-ring 184 can be provided between the supporting plate 16 and the top side of the housing 17.

The key module 140, the indicator module 141 and the charging interface 142 are set on the control circuit board 14. The key module 140, the indicator module 141 and the charging interface 142 are electrically connected to the control circuit board 14. The key module 140 is used to switch on or off or set functions. The indicator module 141 is used to display the working modes or power on/off status or indicate the battery level, etc.

The lower bottom walls of the frame 18 and the housing 17 define through holes, and the charging interface 142 extends outward through the through holes. A rubber plug 185 and a plate 186 for mounting the rubber plug 185 are provided outside the bottom wall of the housing 17. The plate 186 is fastened to the edge of the bottom wall of the housing 17. A connecting end of the rubber plug 185 passes through the through hole in the bottom wall of the housing 17 and can be fixedly or clamped to the lower bottom wall of the frame 18. The plug of the rubber plug 185 removably covers the charging interface 141. An end cover 183 is provided at the bottom side of the handle 100, and the end cover 183 is used to cover and protect the rubber plug 185 and the charging interface 141. When charging is required, remove the end cover 183 and then unplug the rubber plug 185 to use the charging interface 141 to connect to a power supply through the electric wire. An O-ring 184 can be provided between the end cover 183 and the bottom wall of the housing 17.

In the electric shaving brush 1000 of the present invention, the brush head 200 is rotatably installed in the cavity 160 in the top side of the handle 100, and is detachable along the central line L or the longitudinal direction (or the direction of magnetic attraction). The brush head 200 is equipped with the first magnet 22 therein, the second magnet 22' is disposed in the top cavity 160 at the top side of the handle 100. The bristle base 201 of the brush head 200 and the bristle cup 21 can be made of magnetic materials (such as magnet or iron) to match the magnets 22 and 22' to obtain magnetic adsorption to each other. The bristle cup 21 at the bottom of the brush head 200 is provided with the mounting slot 214 for installing the magnets 22 and 22', and the first magnet 22 can be tightly fitted in the mounting slot (specifically, there is no relative movement in the rotation direction), when the brush head 200 is connected to the top side of the handle 100, the second magnet 22' is also fitted in the mounting slot in the bristle cup 21 (specifically, there is no relative movement in the rotation direction). Each of the first magnet 22 and the second magnet 22' is provided with a through hole 220, 220' in the center, and the end of the output shaft 130 of the output gear 13 in the handle 100 passes through the center through holes 220, 220' of the first magnet 22 and the second magnet 22' and is fixed in the rotation direction. The handle 100 and the brush head 200 are connected by magnetic attraction, and the output shaft 130 takes the brush head 200 to rotate synchronously together. The motor 15 in the handle 100 drives the motor gear 10 connected to the motor output shaft to rotate, and drives the output gear 13 to rotate through the meshing transmission of the intermediate gears 11 and 12. In some embodiments, the motor gear 10 meshes with the output gear 13 to drive the output gear 13 to rotate directly or through one or more intermediate gears.

The motor 15 of the electric shaving brush 1000 cooperates with the gear set to achieve a high-speed rotation of the brush head 200 for foaming shave cream/soap/gel. The rotational speed is adjustable, and various rotational speed levels can be obtained, such as a first high-speed level for foaming shave cream, a second speed level for applying lather, a third high-speed level for cleaning bristles 20, and a fourth high-speed level for drying bristles 20. Other speed levels can also be set for the use experience. When the electric shaving brush 1000 is used to foam and stir the shave cream in the shaving bowl 300, the brush head 200 with the bristles 20 at the first high rotational speed can ensure to produce denser and richer lather. When cleaning the bristles 20 in water or a detergent solution after shaving, the brush head 200 with the bristles 20 at the third high rotational speed can clean the residual lather in the bristles quickly and efficiently. After cleaning, the brush head 200 with the bristles 20 at the fourth high rotational speed can dry the remaining water in the bristles. The first high rotational speed, the third high rotational speed, and the fourth high rotational speed can be the same or different.

Referring to FIGS. 8-11, in accordance with the second embodiment of the present invention, the electric shaving brush 1000 is different from that in the first embodiment is the arrangement of the first magnet 22 and the second magnet 22'. Specifically, the top side of the bristle cup 21 forms the assembly cavity 2 with the bottom wall 210, the bottom wall 210 defines a first mounting slot 211 in the assembly cavity 2. A protruding column 212 extends upwardly in the center of the mounting slot 211. The shape of the mounting slot 211 is adapted to the first magnet 22. The first magnet 22 is installed into the mounting slot 211. The protruding pillar 212 is inserted into the central through hole 220 of the first magnet 22 and is fixedly connected to each other in the rotation direction. For example, the first magnet 22 has a square shape, and the mounting slot 211 is a square cavity. The first magnet 22 may be fixed in the mounting slot 211, or the first magnet 22 can be fixed in the rotation direction in the mounting slot 211 while can be pulled out in the longitudinal direction or central line L. As an alternative example, the bristle cup 21 is sleeved with an outer cup 21'; the protruding column 212 in the bristle cup 21 defines a hole therein along its length. The outer cup 21' has a shape adapted to the bristle cup 21, and a bottom wall of the outer cup 21' has a protruding column 212' which is inserted into the hole of the protruding column 212 of the bristle cup 21; the protruding column 212' of the outer cup 21' defines a hole therein along its length for holding the end of the output shaft 130 of the output gear 13. The back of the bottom wall 210 of the bristle cup 21 and the back of the bottom wall 210 of the outer cup 21' each form a second mounting slot 214, and a hole 213 is formed in the center of the bottom wall. The shape of the mounting slot 214 is adapted to a magnet housing 24, and the magnet housing 24 is fitted in the mounting slot 214 without relative rotation therebetween but may be detachable along the longitudinal direction (the central line L).

The second magnet 22' is provided on the bottom wall 162 in the top cavity 160 at the top side of the handle 100, and the second magnet 22' is installed at the end of the output shaft 130 of the output gear 13. The second magnet 22' is annular, with a through hole 220' formed in the center. The second magnet 22' is the same as (or different from) the first magnet 22. For example, each of the second magnet 22' and the first magnet 22 is square, and has a square through hole 220'/220 through its center. The magnet housing 24 is sleeved outside the second magnet 22' to reinforce the second magnet 22' and prevent magnet leakage. The shape of the magnet housing 24 matches the shape of the second magnet 22' and is tightly fitted outside the second magnet 22'. An annular slot 242 is defined in the magnet housing 24, a protruding column 241 is provided in the center of the annular slot 242, and the protruding column 241 defines a central and axial through hole 240 therein. The annular slot 242 and the protruding column 241 are adapted to the second magnet 22'. The second magnet 22' is embedded in the annular slot 242, and the protruding column 241 is inserted into the center through hole 220' of the second magnet 22' and the center through hole 220 of the magnet housing 24. The protruding column 241 may continue to extend upward and be inserted into the hole of the bottom wall of the bristle cup 21. When the second magnet 22' with the outer tight-fitting housing 24 is embedded in the second mounting slot 214 in the bottom wall of the bristle cup 21, and may be tightly fitted in rotation direction while can be separated (pulled out) in the direction of the central line L. The first magnet 22 and the second magnet 22' are permanent magnets. The magnet housing 24 is preferably made of a magnetic material such as iron.

When the brush head 200 is connected to the handle 100, the brush cup 21 is inserted into the top cavity 160 at the top side of the handle 100, the second magnet 22' with the external magnet housing 24 protrudes upward from the bottom wall 162 in the top cavity 160 and is inserted into the mounting slot 214 in the bottom wall of the bristle cup 21 and is fixed in the rotation direction so that the second magnet 22' and the brush head 200 rotate synchronously together; and the two magnets 22 and 22' are magnetically attracted to each other. The end of the output shaft 130 of the output gear 13 is inserted into the central through hole 220' of the second magnet 22' and the central through hole 240 of the magnet housing 24, and can further be inserted into the bottom wall of the bristle cup 21 (or be inserted into the hole of the protruding column 212'), so that the output shaft 130 can take the brush head 200 to rotate. The motor 15 drives the motor gear 10 to take the output gear 13 to rotate directly or through the intermediate gear transmission, and then the output shaft 130 of the output gear 13 drives the brush head 200 to rotate.

Other structures of the electric shaving brush 1000 in accordance with the second embodiment are the same as or similar to the first embodiment.

Referring to FIGS. 12-15, the electric shaving brush 1000 of the present invention is provided with a shaving bowl 300, which is used for foaming shave cream and cleaning and drying the bristles 20. In some embodiments, the electric shaving brush 1000 can be attached and supported on the rotatable bracket 30 on the bubble bowl 300 through magnetic attraction. The rotatable bracket 30 is provided on the open edge of the shaving bowl 300, which can be rotatable and adjustable to various angles to support the electric shaving brush 1000.

The rotatable bracket 30 includes a bearing seat 31, a rotatable arm 32, a supporting plate 33 and a shaft 34. The bearing seat 31 is fixed at the open edge and on the outer wall of the shaving bowl 300, and may include parallel plates (like comb teeth). The parallel plates are spaced apart from each other, each plate defines a shaft hole, and the shaft holes are aligned on a straight line.

The rotatable arm 32 is adapted to the bearing seat 31, and is rotatably installed to the bearing seat 31 through the shaft 34. In an exemplary embodiment, the rotatably arm 32 may include a set of parallel plates 321, such as a set of L-shaped (not limited to L-shaped) parallel plates (like comb teeth), where each plate defines a shaft hole at its bottom end, and the shaft holes are aligned on a straight line too. The set of parallel plates 321 and the parallel plates of the bearing seat 31 are inserted into the space between adjacent plates of each other. The shaft holes of the set of parallel plates 321 and the bearing seat 31 are aligned on the same straight line for the shaft 34 passing through. The supporting plate 33 is connected to the top end of the rotatable arm 32 above the open of the shaving bowl.

The supporting plate 33 comprises a top cover 331 and a bottom cover 332. The top cover 331 and the bottom cover 332 are adapted in shape, snapped together and connected to each other, and defined a cavity inside. A fourth magnet can be provided in the cavity inside the supporting plate 33 to form a magnetic attraction with the third magnet 187 in the handle 100. The supporting plate 33 is adapted to the handle 100 of the electric shaving brush 1000. In a specific example, the supporting plate 33 has a curved surface 330 corresponding to the shape of the handle 100, so that the handle 100 can be fitted to the curved surface 330 of the supporting plate 33. A magnetic attraction force is formed between the third magnet 187 in the housing 17 of the electric shaving brush 1000 and the fourth magnet in the bracket 30 of the shaving bowl 300, so that the electric shaving brush 1000 can be tightly attached to or supported on the bracket 30 of the shaving bowl 300.

Figure 12:
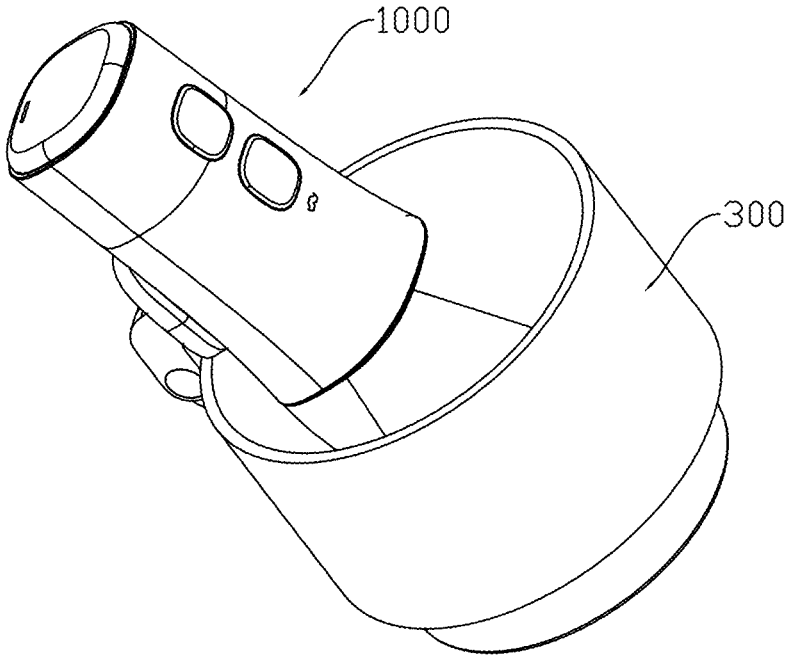
FIGS. 12-13 illustrate perspective views of an assembly with the electric shaving brush attached to a shaving bowl at two positions in accordance with some embodiments of the present invention.
Figure 13:
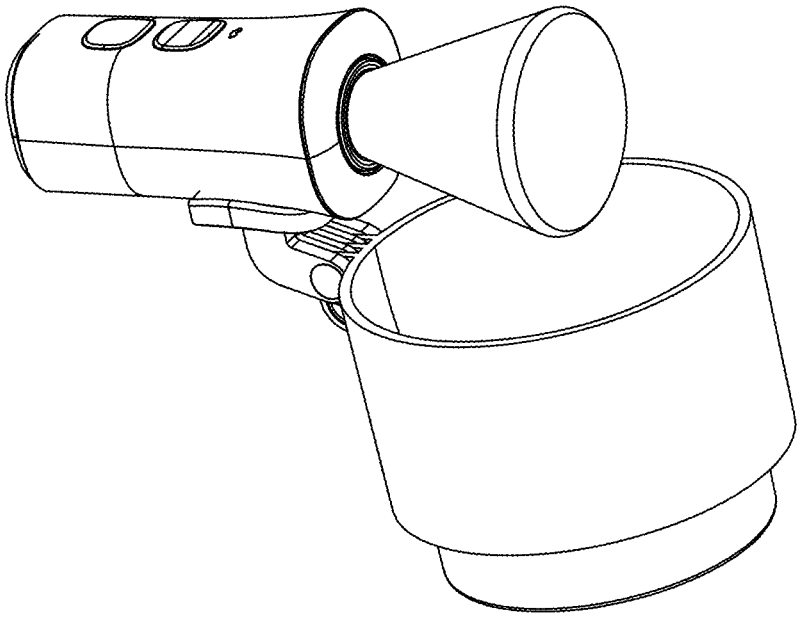
Figure 14:
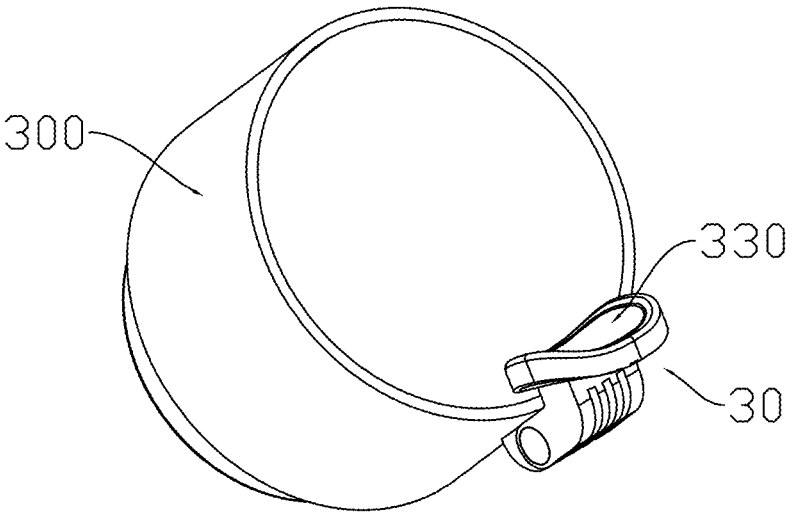
FIG. 14 illustrates a perspective view of the shaving bowl in accordance with an embodiment of the present invention.
Figure 15:
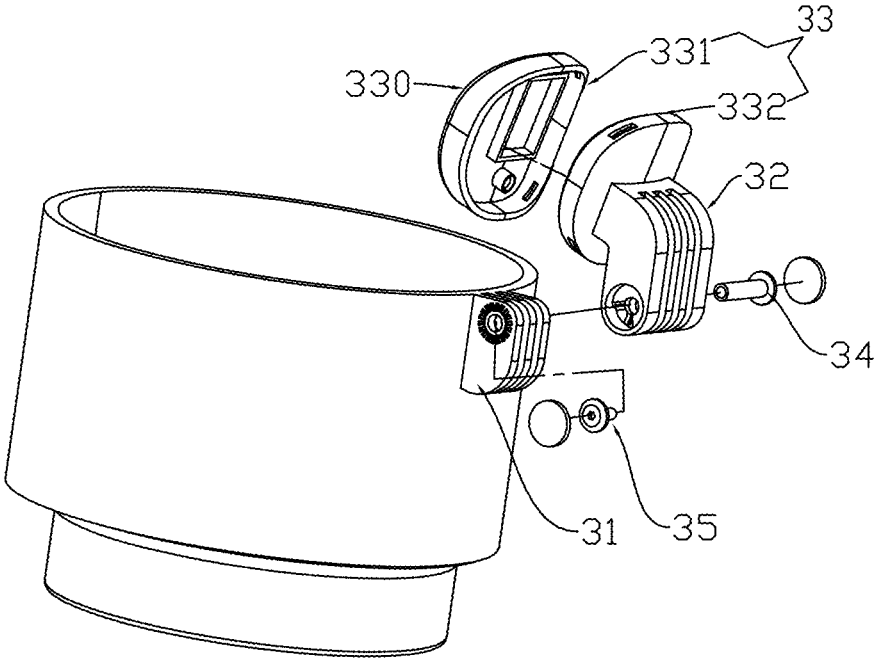
FIG. 15 illustrates an exploded view of the shaving bowl in accordance with the embodiment of the present invention.

The set of parallel plates 321 of the rotatable arm 32 and the bearing seat 31 are rotationally connected through the shaft 34, and the rotatable bracket 30 can rotate to various positions to stably support the electric shaving brush 1000. For example, the rotatable bracket 30 rotates to a horizontal position (as shown in FIG. 13) for horizontally supporting the electric shaving brush 1000 above the open of the shaving bowl 300 for drying the bristles; or, the rotatable bracket 30 rotates to an upright position (as shown in FIG. 12) where the electric shaving brush 1000 can be attracted to and relied on the bracket 30 with the brush head 200 located in the shaving bowl 300.

The supporting plate 33 and/or the entire rotatable bracket 30 may be made of magnetic material. The shaft 34 can be a screw rod with a nut at one end and with the opposite end defining a hole for threading a screw 35. The screw 35 and the nut clamp two outmost shaft holes for installing the shaft 34 through the aligned shaft holes of the set of parallel plates 321 and the bearing seat 31, so that the bracket 30 is rotatably connected to the bearing seat 31.

When the electric shaving brush 1000 works up the shave cream (including gel or soap) into lather in the shaving bowl 300, the electric shaving brush 1000 can be held in hand and is set to rotate at the first high-speed, so that the shave cream can be foamed quickly and produced denser and richer lather. When applying lather to the skin or hair, use the bristles to apply the lather in the shaving bowl to the skin or hair, also start the motor 15 to drive the brush head 200 rotating at the preset second speed for effectively stimulating the skin, raising hairs off the face, exfoliating, and lubricating as well as moisturizing the skin, may manually move the brush head 200 while applying lather on skin. After shaving, detergent or clean water is poured into the shaving bowl 300, the electric shaving brush 1000 is held by hand, is set at the preset third high-speed to clean the residual lather in the bristles 20 quickly and efficiently. After cleaning, the electric shaving brush 1000 is set to the preset fourth high speed to quickly dry the remaining moisture in the bristles 20. After drying the bristles 20, rotate the bracket 30 and adjust it to a horizontal position to place the electric shaving brush 1000.

The above examples only represent several embodiments of the present invention, and the descriptions thereof are specific and detailed, but should not be construed as a limitation on the scope of the invention patent. It should be pointed out that for those of ordinary skill in the art, without departing from the concept of the present invention, several modifications and improvements can also be made, which all belong to the protection scope of the present invention. Therefore, the protection scope of the patent of the present invention should be subject to the appended claims.

What is claimed is:

1. An electric shaving brush, comprising:

a brush head; and a handle;

wherein the brush head is detachably and rotatably connected to a top side of the handle; a control circuit board, a motor and a gear set are provided inside the handle; the motor electrically connected to the control circuit board; the gear set comprises a motor gear and an output gear, the motor drives the motor gear to allow the output gear to rotate, an output shaft of the output gear is connected to the brush head to drive the brush head to rotate, and the electric shaving brush is capable of executing one or more working modes of:

a working mode of foaming: where the brush head rotates at a first speed to make shave cream into lather automatically and quickly and produce more denser and richer lather;

a working mode of applying lather to the skin or hair;

a working mode of cleaning bristles: where the brush head rotates at a third high speed to wash residual lather in bristles in water; and/or, a working mode of drying the bristles: where the brush head rotates at a fourth high speed to dry residual water in the bristles;

wherein a magnetic adsorption connection is formed between the brush head and the handle; the brush head comprises bristles, a bristle cup and a first magnet; the first magnet and the bristles are installed to the bristle cup and are fixed together in a rotation direction of the brush head; a second magnet is provided at the top side of the handle; the output shaft of the output gear is connected to the bristle cup to take the bristle cup to rotate together; when the brush head is connected to the top side of the handle, the magnetic attraction is formed between the first magnet and the second magnet;

the bristles form or are attached to a base; the bristle cup comprises an annular sidewall and a bottom wall, and defines an assembly cavity adapted to the base and used to install the base, the bottom wall defines a mounting slot adapted to the first magnet, the first magnet is tightly fitted in the mounting slot;

the handle defines a top cavity in the top side thereof, the top cavity is adapted to the bristle cup, and is used to install the bristle cup and the second magnet, the second magnet defines a through hole; and the output shaft is tightly fitted in the through hole of the second magnet;

a top end of the output shaft with a rubber piece outside is tightly fitted in the through hole of the second magnet.

2. The electric shaving brush as claimed in claim 1, wherein the handle includes a housing, a frame is installed in the housing, a top side of the housing and a top side of the frame are open and covered by a top cover; the top cover forms a top cavity for installing the brush head;

the frame defines a gear cavity at top side thereof for installing the gear set, the gear set is rotatably installed on a bottom wall of the gear cavity, an open top of the gear cavity is covered by the top cover; the frame defines a main accommodation cavity therein, and the motor, the control circuit board and a battery are installed in the main accommodation cavity; a top bottom wall of the frame separates an inner space of the frame into the gear cavity and the main body accommodation cavity up and down; the top bottom wall is provided with shaft holes and/or columns each with a shaft hole, a shaft of each gear of the gear set is rotatably installed in the shaft hole; a bottom end of the shaft of the motor gear passes downward through the shaft hole in the top bottom wall and is connected to the motor; the top cover is provided with shaft holes and/or columns each with a shaft hole; a top end of the shaft of each gear is rotatably inserted in the shaft hole of the top cover; the top end of the output shaft passes through a hole in the bottom wall of the bristle cup.

3. The electric shaving brush as claimed in claim 2, wherein the control circuit board is provided with a key module, an indicator module and a charging interface; the housing and the frame are provided with through holes to install the key module, the indicator module and the charging interface; a bottom of the housing is provided with an end cover, which is used to cover and protect the charging interface; the charging interface is covered by a pull-out rubber plug.

4. The electric shaving brush as claimed in claim 2, wherein the shaft of each gear of the gear set is parallel or collinear with the central line; the gear set includes one or more intermediate gears, the intermediate gears are installed coaxially or mesh with each other; the motor gear meshes with one intermediate gear, and the intermediate gear meshes with the output gear, so that the motor gear drives the output gear to rotate through intermediate gear transmission.

5. The electric shaving brush as claimed in claim 2, wherein a third magnet is provided in the handle to form a magnetic adsorption with a fourth magnet in a bracket on the shaving bowl;

the third magnet is installed in a groove in an inner wall of the housing; the housing of the handle has a curved surface; the first magnet is a permanent magnet, the second magnet is a permanent magnet, and the third magnet is a permanent magnet.

6. An electric shaving brush, comprising:

a brush head; and a handle;

wherein the brush head is detachably and rotatably connected to a top side of the handle;

a control circuit board, a motor and a gear set are provided inside the handle; the motor electrically connected to the control circuit board; the gear set comprises a motor gear and an output gear, the motor drives the motor gear to allow the output gear to rotate, an output shaft of the output gear is connected to the brush head to drive the brush head to rotate, and the electric shaving brush is capable of executing one or more working modes of:

a working mode of foaming: where the brush head rotates at a first speed to make shave cream into lather automatically and quickly and produce more denser and richer lather;

a working mode of applying lather to the skin or hair;

a working mode of cleaning bristles: where the brush head rotates at a third high speed to wash residual lather in bristles in water; and/or, a working mode of drying the bristles: where the brush head rotates at a fourth high speed to dry residual water in the bristles;

wherein a magnetic adsorption connection is formed between the brush head and the handle; the brush head comprises bristles, a bristle cup and a first magnet; the first magnet and the bristles are installed to the bristle cup and are fixed together in a rotation direction of the brush head; a second magnet is provided at the top side of the handle; the output shaft of the output gear is connected to the bristle cup to take the bristle cup to rotate together; when the brush head is connected to the top side of the handle, the magnetic attraction is formed between the first magnet and the second magnet;

the bristles form or are attached to a base; the bristle cup comprises an annular sidewall and a bottom wall, and defines an assembly cavity adapted to the base and used to install the base, the bottom wall defines a mounting slot adapted to the first magnet, the first magnet is tightly fitted in the mounting slot;

the handle defines a top cavity in the top side thereof, the top cavity is adapted to the bristle cup, and is used to install the bristle cup and the second magnet, the second magnet defines a through hole;

the second magnet is covered with a magnet housing; the magnet housing is adapted to the second magnet; the magnet housing defines a through hole; the top end of the output shaft is tightly fitted in the through holes of the second magnet and the magnet housing:

the magnet housing is provided with an annular slot and a protruding column at a center of the annular slot; the through hole of the magnet housing extends through a length of the protruding column; the protruding column is adapted to the through hole of the second magnet; the second magnet is tightly fitted in the annular slot, and the protruding column is inserted in the through hole of the second magnet;

the base of the bristles is fixedly installed in the assembly cavity of the bristle cup; or, the base is relatively fixed in the rotation direction and detachable from the assembly cavity.

7. The electric shaving brush as claimed in claim 6, wherein the first magnet defines a through hole; a protruding column is provided at the center of the mounting slot of the bottom wall, and the protruding column is adapted to and fitted in the through hole of the first magnet; when the brush head is connected to the handle, the second magnet is embedded in the mounting slot and is relatively fixedly in the rotation direction; and a top end of the output shaft is inserted in a hole defined in the bottom wall of the bristle cup.

8. The electric shaving brush as claimed in claim 6, wherein the handle includes a housing, a frame is installed in the housing, a top side of the housing and a top side of the frame are open and covered by a top cover; the top cover forms a top cavity for installing the brush head;

the frame defines a gear cavity at top side thereof for installing the gear set, the gear set is rotatably installed on a bottom wall of the gear cavity, an open top of the gear cavity is covered by the top cover; the frame defines a main accommodation cavity therein, and the motor, the control circuit board and a battery are installed in the main accommodation cavity; a top bottom wall of the frame separates an inner space of the frame into the gear cavity and the main body accommodation cavity up and down; the top bottom wall is provided with shaft holes and/or columns each with a shaft hole, a shaft of each gear of the gear set is rotatably installed in the shaft hole; a bottom end of the shaft of the motor gear passes downward through the shaft hole in the top bottom wall and is connected to the motor; the top cover is provided with shaft holes and/or columns each with a shaft hole; a top end of the shaft of each gear is rotatably inserted in the shaft hole of the top cover; the top end of the output shaft passes through a hole in the bottom wall of the bristle cup.

9. The electric shaving brush as claimed in claim 8, wherein the control circuit board is provided with a key module, an indicator module and a charging interface; the housing and the frame are provided with through holes to install the key module, the indicator module and the charging interface; a bottom of the housing is provided with an end cover, which is used to cover and protect the charging interface; the charging interface is covered by a pull-out rubber plug.

10. The electric shaving brush as claimed in claim 8, wherein the shaft of each gear of the gear set is parallel or collinear with the central line; the gear set includes one or more intermediate gears, the intermediate gears are installed coaxially or mesh with each other; the motor gear meshes with one intermediate gear, and the intermediate gear meshes with the output gear, so that the motor gear drives the output gear to rotate through intermediate gear transmission.

11. The electric shaving brush as claimed in claim 8, wherein a third magnet is provided in the handle to form a magnetic adsorption with a fourth magnet in a bracket on the shaving bowl;

the third magnet is installed in a groove in an inner wall of the housing; the housing of the handle has a curved surface; the first magnet is a permanent magnet, the second magnet is a permanent magnet, and the third magnet is a permanent magnet.

12. A shaving assembly, comprising a shaving bowl and an electric shaving brush wherein the electric shaving brush, comprising:

a brush head; and a handle;

wherein the brush head is detachably and rotatably connected to a top side of the handle;

a control circuit board, a motor and a gear set are provided inside the handle; the motor electrically connected to the control circuit board; the gear set comprises a motor gear and an output gear, the motor drives the motor gear to allow the output gear to rotate, an output shaft of the output gear is connected to the brush head to drive the brush head to rotate, and the electric shaving brush is capable of executing one or more working modes of:

a working mode of foaming: where the brush head rotates at a first speed to make shave cream into lather automatically and quickly and produce more denser and richer lather;

a working mode of applying lather to the skin or hair;

a working mode of cleaning bristles: where the brush head rotates at a third high speed to wash residual lather in bristles in water; and/or, a working mode of drying the bristles: where the brush head rotates at a fourth high speed to dry residual water in the bristles;

wherein a bracket is provided on an open edge of the shaving bowl, and the bracket is rotatable and adjustable to support the electric shaving brush at various positions.

13. The shaving assembly as claimed in claim 12, wherein a third magnet is provided in the handle of the electric shaving brush, and a fourth magnet is provided in the bracket; the handle is attracted to the bracket through a magnetic force between the third magnet and the fourth magnet.

14. The shaving assembly as claimed in claim 13, wherein the bracket comprises:

a bearing seat, which is fixed on an outer wall of the shaving bowl and defines one or more shaft holes;

a rotatable arm, which defines one or more shaft holes;

a supporting plate; and a shaft;

the rotatable arm is rotatably connected to the bearing seat through the shaft; the supporting plate is connected to the rotatable arm; the rotatable arm is adapted to the bearing seat, the shaft is rotatably inserted in the shaft holes of the rotatable arm and the bearing seat; a fourth magnet is provided in the supporting plate to form a magnetic attraction with the third magnet in the handle; the supporting plate has a curved surface, the handle has a corresponding curved surface, the curved surfaces of the supporting plate and the handle match to each other, whereby contact surfaces of the supporting plate and the handle are fitted to each other.

* * * * *